US005723271A

United States Patent [19]

Smith et al.

[11] Patent Number: 5,723,271

[45] Date of Patent: Mar. 3, 1998

[54] PHOTOGRAPHIC ELEMENTS HAVING A PROCESS-SURVIVING POLYSILOXANE BLOCK COPOLYMER BACKING

[75] Inventors: Thomas M. Smith, Spencerport; Vito A. DePalma, Rochester; Scott E. Tunney, Ontario, all of N.Y.

[73] Assignee: Eastman Kodak Company, Rochester, N.Y.

[21] Appl. No.: 752,339

[22] Filed: Nov. 19, 1996

[51] Int. Cl.[6] ..... G03C 1/53; G03C 1/835; G03C 1/89; G03C 1/76

[52] U.S. Cl. ..... 430/517; 430/527; 430/533; 430/961; 430/530

[58] Field of Search ..... 430/531, 533, 430/272.1, 961, 527, 517, 530

[56] References Cited

U.S. PATENT DOCUMENTS

| | | | |
|---|---|---|---|
| 3,080,317 | 3/1963 | Tallet et al. | 252/49.6 |
| 3,121,060 | 2/1964 | Duane | 252/56 |
| 3,206,311 | 9/1965 | Campbell et al. | 430/523 |
| 3,708,458 | 1/1973 | Alberino et al. | 260/65 |
| 3,856,752 | 12/1974 | Bateman et al. | 260/65 |
| 3,933,516 | 1/1976 | Mackey | 106/135 |
| 4,047,958 | 9/1977 | Yoneyama et al. | 430/531 |
| 4,404,276 | 9/1983 | Steklenski | 430/531 |
| 4,427,764 | 1/1984 | Tachibana et al. | 430/523 |
| 4,499,149 | 2/1985 | Berger | 428/447 |
| 4,623,614 | 11/1986 | Yoneyama et al. | 430/523 |
| 4,675,278 | 6/1987 | Sugimoto et al. | 430/531 |
| 4,736,015 | 4/1988 | Rabilloud et al. | 528/353 |
| 4,820,615 | 4/1989 | Vandenabeele et al. | 430/531 |
| 5,234,889 | 8/1993 | DePalma et al. | 503/227 |
| 5,252,534 | 10/1993 | DePalma et al. | 503/227 |
| 5,283,164 | 2/1994 | Fenton et al. | 430/506 |
| 5,288,602 | 2/1994 | Geiger et al. | 430/536 |

FOREIGN PATENT DOCUMENTS

| | | |
|---|---|---|
| 395107 | 10/1990 | European Pat. Off. . |
| 518627 | 12/1992 | European Pat. Off. . |
| 1143118 | 2/1969 | United Kingdom . |
| 1198387 | 7/1970 | United Kingdom . |
| 1263722 | 2/1972 | United Kingdom . |
| 1430997 | 4/1976 | United Kingdom . |
| 1431782 | 4/1976 | United Kingdom . |
| 2016167 | 9/1979 | United Kingdom . |
| 955061 | 4/1996 | United Kingdom . |

*Primary Examiner*—Richard L. Schilling

[57] ABSTRACT

A photographic element is disclosed which comprises (a) a support, (b) a radiation-sensitive silver halide emulsion layer on one side of the support, and (c) a protective backing on the opposite side of the support which provides scratch and abrasion resistance and process surviving lubricity. The protective backing is comprised of one or more layers, the outermost of which comprises a film-forming hydrophobic lubricious polyester-siloxane block copolymer and a hydrophobic co-binder which does not contain polysiloxane block units. In preferred embodiments of the invention, the backing further comprises a solid particle dye dispersion of a filter dye which is readily soluble or decolorizable in alkali aqueous photographic processing solutions at pH of 8 or above dispersed in an alkaline aqueous insoluble, organic solvent soluble film forming binder, and an electrically conductive agent, such that the backing provides halation protection during exposure as well as process-surviving antistatic protection. The present invention provides photographic elements with a backing which provides photographic process-surviving lubricity. In preferred embodiments, the backing includes a filter dye layer which provides effective antihalation protection, where the filter dyes are decolorized or removed upon processing, preferably over a protected antistatic layer. The invention employs hydrophobic, inherently lubricious, polymeric binder combinations that may be used as film-backing binders for anti-halation dyes, provide an adequate level of scratch and abrasion resistance, an appropriate level of process-surviving slip or friction, and is coatable from relatively safe organic solvents.

20 Claims, No Drawings

PHOTOGRAPHIC ELEMENTS HAVING A PROCESS-SURVIVING POLYSILOXANE BLOCK COPOLYMER BACKING

FIELD OF THE INVENTION

This invention relates in general to photography, and in particular to improved photographic silver halide elements. More specifically, this invention relates to photographic silver halide elements having a photographic process-surviving backing which provides scratch and abrasion resistance and lubricity, and also preferably halation protection and process-surviving static protection.

BACKGROUND OF THE INVENTION

In the manufacture of photographic silver halide elements, it is frequently deskable to provide a backing that is characterized by a relatively low coefficient of friction. This is generally obtained by providing an outermost lubricating layer on the side of the photographic element support opposite to the silver halide emulsion layer or layers. Such lubricating layers are especially useful for motion picture films (e.g., camera negative, intermediate, and release print films) which must have frictional characteristics which facilitate their transport through exposing, printing, and projection equipment.

A wide variety of materials have been proposed heretofore for use as a lubricating layer in a silver halide photographic element. Examples of such materials include: blends of pentaerythritol tetrastearate and pentaerythritol tetraacetate (British Pat. No. 1,430,997), carnauba wax coated from trichloroethylene and cyclohexane (British Pat. No. 1,431,782), water-insoluble alkaline earth metal salts of higher aliphatic carboxylic acids dispersed in a hydrophilic colloid (British Pat. No. 1,263,722), calcium stearate and stearamido-propyl dimethyl-beta-hydroxy-ethyl ammonium nitrate dispersed in gelatin (U.S. Pat. No. 3,933,516), branched aliphatic hydrocarbon esters coated with a binder such as cellulose diacetate (EP 0 395 107), wax combined with polymer binder dispersed in hydrophilic colloid (U.S. Pat. No. 4,820,615), wax particles, such as homopolymeric polyethylene wax, dispersed in hydrophilic colloid binder (EP 0 518 627), high molecular weight water-insoluble ethers dispersed in hydrophilic colloid binder (British Pat. No. 1,198,387), waxy esters of higher fatty alcohols and high fatty acids (U.S. Pat. No. 3,121,060), high molecular weight esters dispersed in a hydrophilic colloid binder (U.S. Pat. No. 4,427,764), primary straight-chain amides derived from higher fatty acids dispersed in a polymeric binder (U.S. Pat. No. 3,206,311), alkyl polysiloxane compounds (British Pat. No. 955,061, U.S. Pat. No. 4,047,958, U.S. Pat. No. 4,675,278), phenyl-substituted siloxanes (British Pat. No. 1,143,118), silicone oil incorporated in gelatin layers (U.S. Pat. No. 5,288,602), mixture of alkyl and aryl silicones (U.S. Pat. No. 3,080,317), blend of an epoxy-terminated silane and a silicone fluid (British Pat. No. 2,016,167), blend of polymeric binder and cross-linked silicone polycarbinol (U.S. Pat. No. 4,404,276), and polymers or copolymers comprising grafted silicone units (U.S. Pat. No. 4,623,614).

The conventional materials heretofore proposed for use in lubricating layers of silver halide photographic elements suffer from one or more disadvantages that have hindered their commercial utilization. For example, they may require the use of particular organic coating solvents that are environmentally disadvantageous; they may involve the use of costly materials and/or complex arrangements of multiple layers; they may not be capable of surviving photographic processing; they may require the use of crosslinked materials which have a short "pot life" and are therefore difficult to coat; they may be ineffective in providing the desired level of lubricity; they may provide inadequate level of scratch and abrasion resistance; or they may require complex synthesizing techniques involving grafting procedures with practical limits as to material compositions and performance.

Photographic elements typically also comprise some form of antihalation protection. Halation has been a persistent problem with photographic films comprising one or more photosensitive silver halide emulsion layers coated on a transparent support. The emulsion layer diffusely transmits light, which then reflects back into the emulsion layer from the support surface. The silver halide emulsion is thereby reexposed at locations different from the original light path through the emulsion, resulting in "halos" on the film surrounding images of bright objects.

One method proposed for preventing halation in photographic films comprises using a support which contains dyes or pigments. Such approach is undesirable for negative or projection or slide print films, as the added dyes or pigments in the support would require higher intensity printing exposures for negative films and detract from the projected image of print films.

Another proposed method comprises providing a dyed or pigmented layer behind a clear support as an antihalation backing layer, wherein the backing layer is designed to be removed during processing of the film, as disclosed in, e.g., U.S. Pat. No. 4,914,011. Typical examples of such antihalation backing layers comprise a dye or pigment (such as carbon black) which functions to absorb the light dispersed in an alkali-soluble polymeric binder (such as cellulose acetate hexahydrophthalate) that renders the layer removable by an alkaline photographic processing solution. Such backing layers have been commonly used for antihalation protection in motion picture rims. Such backing layers provide effective antihalation protection during exposure, however, their use requires special additional processing steps for their subsequent removal, and incomplete removal of the pigmented antihalation layer can cause image defects in the resulting print film. Additionally, such removable layers fall to provide any scratch and abrasion resistance, lubricity and antistatic protection for the processed element after their removal.

A third proposed method for antihalation protection for photographic materials comprises use of an antihalation hydrophilic colloid undercoat layer containing filter dyes or silver metal coated between the support and the emulsion layers, wherein the filter dyes or silver is solubilized and removed during processing of the film without removal of the hydrophilic colloid layer itself. Such antihalation undercoats have also been commonly used in motion picture films. For hydrophilic colloid antihalation and filter layers coated on the same side of the support as the light sensitive emulsion layers of a photographic element, filter dyes are typically incorporated into such layers as water soluble dyes, as conventional oil-in-water dispersions, as loaded polymeric latex dispersions, or as aqueous solid particle dispersions. Filter dyes coated in such layers, however, are known to sometimes diffuse at least partially to adjacent emulsion layers, where they may sensitize the emulsion to an unwanted part of the spectrum. Mordanted filter dyes are generally less susceptible to wandering, but result in greater dye stain after photographic processing. Filter dyes and mordants may also interact undesirably with other components in the same layer or adjacent layers of the film. The incorporation of filter dyes which are relatively insoluble at aqueous coating pH's of less than 7 and readily soluble and/or decolorizable at alkali processing pH's of above 8 in the form of aqueous solid particle dispersions as disclosed in, e.g., Lemahieu et al in U.S. Pat. No. 4,092,168, Ailliet et al in U.S. Pat. No. 4,770,984, Factor et al in U.S. Pat. No. 4,900,653 and Diehl et al in U.S. Pat. No. 4,940,654, have helped minimize such dye wandering and dye stain problems.

While the incorporation of filter dyes as solid particle dispersions may help alleviate problems to a certain extent, the presence of solid particle dyes in sufficient quantities may also cause layer adhesion problems to the support. Another problem associated with solid particle dispersions of filter dyes which are relatively insoluble at aqueous coating pH's of less than 7 and readily soluble and/or decolorizable at alkali processing pH's of above 8, is their hydrophobicity at low pH coupled with the presence of ionogenic groups such as carboxyl, hydroxyl, etc., often makes it difficult to obtain stable, freely divided, solid particle dispersions of these dyes in water at high concentrations using conventional surfactants as dispersing agents. The viscosities of such dispersions tend to rise with decreasing particle size due to interparticle interaction which causes flocculation, and it has been found that the protection of conventional surfactants and polymers against such flocculation in an aqueous medium is often insufficient for obtaining stable aqueous solid particle dispersions of these dyes in concentrations higher than about 5 weight percent.

It may be desirable to coat filter dyes on the opposite side of the support as the aqueous coated emulsion layers. For hydrophilic colloid antihalation or filter layers coated on the side of the transparent support opposite to that carrying the emulsion layers (where the layer is not alkali soluble itself), water soluble filter dyes are usually coated from an aqueous coating solution. Such dyes are readily removed during processing of the photographic element with aqueous processing solutions, and the presence of the support prevents such dyes from diffusing into the photographic element emulsion layers prior to processing and causing the above noted problems.

The use of water soluble filter dyes in a backing layer solves several problems related with the use of dyes or pigments (such as carbon black) in an alkali soluble, process removable binder as discussed above, as antihalation and filter layers having alkali soluble binders have the disadvantage of creating dust that can smear the photographic elements, and they are cumbersome to remove before development of the film. However, coating a layer on the backside of a photographic element often requires the use of an organic solvent due to various constraints. These may include coating on or over water-sensitive layers or supports, coating at high speeds with limited drying capabilities, coating of water insoluble film forming binders, and coating where the presence of substantial mounts of water will impede efficient recovery of organic solvents used elsewhere in the manufacturing process.

Copending, commonly assigned U.S. patent application Ser. No. 08/698,413, filed Aug. 15, 1996 discloses the use of nonaqueous solid particle dye dispersions of filter dyes which effectively provide filter or antihalation protection in an organic solvent coated layer, which layer itself is not removed during photographic processing, on the backside of a photographic element, where such dyes are solubilized and removed or at least decolorized during processing with an alkaline photographic processing solution. As disclosed therein, photographic film element containing such dyes in a permanent layer on the back of the film support, may be used in combination with antistatic materials and conventional lubricants such as discussed above either in the dye layer or in separate permanent layers, such that the film element also provides the properties of abrasion resistance, lubricity and antistatic protection, which properties are also retained after photographic processing. The conventional materials heretofore proposed for use in lubricating layers of silver halide photographic elements as discussed above, however, suffer from one or more disadvantages that have hindered their commercial utilization.

Any lubricant used over an antihalation layer comprising dyes which are to be removed upon photographic processing as disclosed in U.S. Ser. No. 08/698,413 must also be sufficiently permeable to processing solution to allow the dyes to be dissolved and/or decolorized by the processing solution. In order to retain lubricity in the element after processing, however, such lubricant itself must survive processing. Moreover, if other agents, such as antistatic agents, which are soluble in processing baths are incorporated in the lubricating layer, or in a layer beneath the lubricating layer, inability of the lubricating layer to survive processing will mean that the photographic element will be lacking in post-process antistatic protection as well as post-process lubricity.

It is toward the objectives of providing an improved backing for a photographic element that provides lubricity and which is process-surviving, and which also preferably provides halation protection and process-surviving antistatic protection, and that overcomes many of the disadvantages and shortcomings of the prior art, that this invention is directed.

SUMMARY OF THE INVENTION

In accordance with one embodiment of the invention, a photographic element is disclosed which comprises (a) a support, (b) a radiation-sensitive silver halide emulsion layer on one side of the support, and (c) a protective backing on the opposite side of the support which provides scratch and abrasion resistance and process surviving lubricity. The protective backing is comprised of one or more layers, the outermost of which comprises a film-forming hydrophobic lubricious polyester-siloxane block copolymer and a hydrophobic co-binder which does not contain polysiloxane block units. In preferred embodiments of the invention, the backing further comprises a solid particle dye dispersion of a filter dye which is readily soluble or decolorizable in alkali aqueous photographic processing solutions at pH of 8 or above dispersed in an alkaline aqueous insoluble, organic solvent soluble film forming binder, and an electrically conductive agent, such that the backing provides halation protection during exposure as well as process-surviving antistatic protection.

ADVANTAGES OVER PRIOR ART

The present invention provides photographic elements with a backing which provides photographic process-surviving lubricity. In preferred embodiments, the backing includes a filter dye layer which provides effective antihalation protection, where the filter dyes are decolorized or removed upon processing, preferably over a protected antistatic layer. Pre-processing physical properties of antihalation protection, abrasion resistance, lubricity and antistatic properties can be obtained which are equal to or superior to the prior art of removable backing layers containing carbon, while the properties of abrasion resistance, lubricity and antistatic protection are also advantageously retained after processing, unlike films that contain carbon on the back of the support. This is especially desirable for motion picture film materials, which are subject to continued rapid transport processes even after photographic processing. Additionally, many disadvantages associated with prior art lubricants are overcome while retaining the above advantages. The invention employs hydrophobic, inherently lubricious, polymeric binder combinations that may be used as film-backing binders for anti-halation dyes, provide an adequate level of scratch and abrasion resistance, an appropriate level of process-surviving slip or friction, and is coatable from relatively safe organic solvents.

DETAILED DESCRIPTION OF THE INVENTION

Protective backings for photographic elements in accordance with the invention comprise one or more layers, the outermost of which comprises a film-forming hydrophobic lubricious polyester-siloxane block copolymer and a hydrophobic co-binder which does not contain polysiloxane block units. Preferably, the polysiloxane components comprise more than 3 weight % of the polyester-siloxane copolymer and the average molecular weight of the polysiloxane block components is at least about 1500, and the polyester-siloxane copolymer comprises from about 3 to 80 wt %, more preferably at least 15 wt % and at most 50 wt %, of the total polymeric binder weight in the outermost layer in order to provide the most effective process-surviving lubricity characteristics. The outermost layer may be a separate layer coated over a filter dye containing antihalation layer and/or an antistatic layer, or filter dyes or antistatic materials may be included in the outermost layer, in which instance the polyester-siloxane block copolymer and the cobinders function as the filter dye layer or antistatic layer binder. Matting agents may also be included in the backing in order to improve transport properties of the elements of the invention on manufacturing, printing, processing, and projecting equipment. Such matting agents can also help prevent sticking between the front and back sides of the elements in a tightly wound roll. Matting agents may be silica, calcium carbonate, other mineral oxides, glass spheres, ground polymers, high melting point waxes, and polymeric matte beads.

In preferred embodiments, the polyester-siloxane block copolymers are linear and solvent-soluble. By "linear" it is meant that the polymers consists essentially of recurring units containing esters and siloxane block units in the polymer backbone and that such recurring units are present essentially in the form of long chains. By "solvent-soluble" it is meant that the polyester-siloxane must be at least slightly soluble in organic solvents.

A preferred class of solvent-soluble polyester-siloxane block copolymers includes copolymers containing recurring units having the structural formula:

$$\text{+A+B}\rangle\text{+C+}$$

wherein A represents units derived from carbonic acid or an aromatic or aliphatic dicarboxylic acid such as terephthalic acid, isophthalic acid, azeleic acid, 1,1,3-trimethyl-3-(4'-carboxy-phenyl)-5-carboxyindane, etc.;

B represents units derived from an aromatic or aliphatic diol such as ethylene glycol, 1,4-butane diol, diethylene glycol, 2,2-dimethylpropane diol, 1,4-cyclohexane diol, 4,4'-(hexahydro-4,7-methanoindene-5-ylidene)diphenol, 4,4'dihydroxy-diphenylsulfone, 4,4'-(hexafluoro-isopropylindene) diphenol, or bisphenol-A having the formula

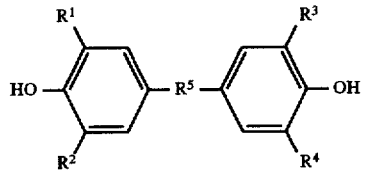

wherein $R^1$, $R^2$, $R^3$, $R^4$ each individually represents H or an alkyl group preferably containing from 1 to 4 carbon atoms, Cl or Br; and $R^5$ represents 4,7-methanoindene-5-ylidene, diphenylsulfone, isopropylidene or hexafluoroisopropylidene; and C represents a polysiloxane block unit derived from a polysiloxane compound having the structural formula:

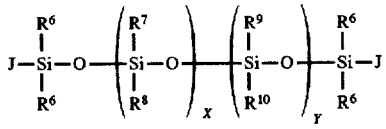

wherein:

each J independently represents a reactive end group which is removed to form a direct bond with A and B units forming silyl ester linkages, or an aliphatic, cycloaliphatic, or aromatic organic group having a reactive end group such as amino, hydroxy, carboxylic acid or derivative which forms amide, urethane or ester linkages with the A and B units. J may be, for example, chloro or dialkylamino to yield silyl ester linkages, carboxypropyl or hydroxybutyl to yield ester linkages, aminopropyl or aminophenyl to yield amide linkages, isocyanatopropyl to yield urethane linkages. Preferably, the organic group comprises an alkyl, fluoroalkyl or alkoxy group having from 1 to about 5 carbon atoms or an aryl group having from 6 to about 12 carbon atoms;

$R^6$, $R^7$, $R^8$, $R^9$, and $R^{10}$ each independently represents alkyl or fluoroalkyl, preferably of 1 to about 5 carbon atoms, or aryl, preferably of from 6 to about 12 carbon atoms; and the values of X and Y are each from 0 to about 400, such that the value of X+Y is from 20 to about 400.

The polysiloxane content of the copolymer can be varied optimally over a range of 3 to 70 weight %. The copolymers may be synthesized to produce a random block copolymer, or can be made so that the polysiloxane block is specifically attached to the polyester as an end group or as a center block.

The poly(dimethylsiloxanes) block units which can be employed in the invention are available commercially such as SWS F881-A, mol. wt. 1700; SWS F881-B, mol. wt. 3900; and SWS F881-C, mol. wt. 7400; (Waker Silicones Co.); PS-510, mol. wt. 2500; and PS-513, mol. wt. 27,000; (Huls America Co.); and X2-2616, mol. wt. 14,000 (Dow Corning).

Solvent-soluble polyester-siloxanes block copolymers useful in the practice of this invention can be prepared by techniques well known to those skilled in the art. Illustrative preparations of polyester-siloxanes for use in accordance with the instant invention are set forth in U.S. Pat. No. 5,234,889, the disclosure of which is incorporated by reference herein, which patent is directed towards the use of such polymers in thermal dye transfer dye-doner elements.

Polyester-siloxanes block copolymers in accordance with the invention may be prepared, e.g., by addition of an equimolar amount of diacid chloride in dichloromethane to a solution of a diol, a polysiloxane, and pyridine in dichloromethane at 10° C. The diacid chloride solution is added dropwise over 45 minutes. The reaction mixture is warmed to room temperature and stirred for 2 hours. To this solution, a 1% diacid chloride in dichloromethane is added dropwise until no further increase in viscosity is observed. The mixture is then stirred for 1 hour. The mixture is diluted with dichloromethane, washed with 10% HCl followed by three washes with distilled water. The solution is precipitated into methanol, and the polymer is isolated by vacuum filtration, washed with methanol and dried under vacuum at 100° C. overnight.

The polyester-siloxane copolymers are used in the outermost backing layer in combination with other film-forming binders which do not contain polysiloxane block units, such as, e.g., vinyl chloride-vinyl acetate copolymers, vinyl chloride-vinyl acetate-vinyl alcohol copolymers, vinyl chloride-vinyl acetate-maleic acid polymers, vinyl chloride-vinylidene chloride copolymers, vinyl chloride-acrylonitrile copolymers, acrylic ester-acrylonitrile copolymers, acrylic ester-vinylidene chloride copolymers, methacrylic ester-vinylidene chloride copolymers, methacrylic ester-styrene copolymers, methacrylate homopolymers and copolymers, thermoplastic polyurethane resins, phenoxy resins, polyvinyl fluoride, vinylidene, chloride-acrylonitrile copolymers, butadiene-acrylonitrile copolymers, acrylonitrile-butadiene-acrylic acid copolymers, acrylonitrile-butadiene-methacrylic acid copolymers, polyvinyl butyral, polyvinyl acetal, cellulose derivatives such as cellulose nitrate, cellulose acetate, cellulose diacetate, cellulose triacetate, cellulose acetate butyrate, and cellulose acetate propionate, styrene-butadiene copolymers, polyester resins, phenolic resins, epoxy resins, thermosetting polyurethane resins, urea resins, melamine resins, alkyl resins, urea-formaldehyde resins and the like. Acrylic ester homopolymers and copolymers are preferred co-binders. The film forming binders may include cross-linkable monomers, and the binders may be cross-linked using conventional cross-linking agents to improve abrasion resistance. For crosslinking of binders with isocyanates, e.g., the binder should contain active hydrogen atoms, such active hydrocarbon atoms including —OH, —$NH_2$, —NHR, where R is an organic radical, and the like, as described in U.S. Pat. No. 3,479,310. Other conventional cross-linking agents may also be used.

The polyester-siloxane copolymer preferably comprises from about 3 to 80 wt %, more preferably at least 15 wt % and at most 50 wt %, of the total polymeric binder weight in the outermost layer in order to provide the most effective process-surviving lubricity characteristics. Total binder coverage in the outermost layer is preferably from about 50 to 1000 mg/$m^2$, more preferably at least 100 mg/$m^2$ and less than 500 mg/$m^2$, and most preferably at least 200 mg/$m^2$ and less than 350 mg/$m^2$, in order to provide desirable lubricity while minimizing coverage required for a uniform layer.

In a preferred embodiment of the invention, in addition to the polyester-siloxane block copolymer and co-binders in the outermost layer, the photographic element backing further comprises a solid particle filter dye dispersion to additionally provide antihalation protection. Preferred filter dyes that can be used in accordance with this embodiment are those which are substantially insoluble in an organic solvent coating composition, and readily soluble or decolorizable in alkali aqueous photographic processing solutions at pH of 8 or above, so as to be removed from or decolorized in a photographic element upon photographic processing, as disclosed in U.S. Ser. No. 08/698,413 referenced above, the disclosure of which is hereby incorporated by reference herein in its entirety. By substantially insoluble is meant dyes having a solubility of less than 1% by weight in solution, preferably less than 0.1% by weight. Such dyes are generally of the formula (I):

$$D—(X)_n \qquad (I)$$

where D represents a residue of a substantially insoluble compound having a chromophoric group, X represents a group having an ionizable proton bonded to D either directly or through a bivalent bonding group, and n is 1–7. The residue of a compound having a chromophoric group may be selected from conventional dye classes, including, e.g., oxonol dyes, merocyanine dyes, cyanine dyes, arylidene dyes, azomethine dyes, triphenylmethane dyes, azo dyes, and anthraquinone dyes. The group having an ionizable proton may be, e.g., a carboxyl group, a sulfonamido group, a sulfamoyl group, a sulfonylcarbamoyl group, a carbonylsulfamoyl group, a hydroxy group, and the enol group of a oxonol dye. Such general class of ionizable filter dyes represented by formula (I) is well known in the photographic art, and includes, e.g., dyes disclosed for use in the form of aqueous solid particle dye dispersions as described in International Patent Publication WO 88/04794, European patent applications EP 594 973, EP 549 089, EP 546 163 and EP 430 180; U.S. Pat. Nos. 4,803,150, 4,855,221; 4,857,446, 4,900,652, 4,900,653, 4,940,654, 4,948,717, 4,948,718, 4,950,586, 4,988,611, 4,994,356, 5,098,820, 5,213,956, 5,260,179, and 5,266,454; the disclosures of each of which are herein incorporated by reference. Such dyes are generally described as being insoluble in aqueous solutions at pH below 7, and readily soluble or decolorizable in aqueous photographic processing solutions at pH 8 or above.

Preferred dyes of formula I include those of formula (II):

$$[D—(A)_y]—X_n \qquad (II)$$

where D, X and n are as defined above, and A is an aromatic ring bonded directly or indirectly to D, y is 0 to 4, and X is bonded either on A or an aromatic ring portion of D.

Exemplary dyes for use in accordance with the preferred embodiment of the invention include those in Tables I to X of WO 88/04794, formulas (I) to (VII) of EP 0 456 163 A2, formula (II) of EP 0 594 973, and Tables I to XVI of U.S. Pat. No. 4,940,654 incorporated by reference above. Preferred filter dyes useful in imaging that can be used are illustrated below. It is understood that this list is representative only, and not meant to be exclusive.

Dye D-1
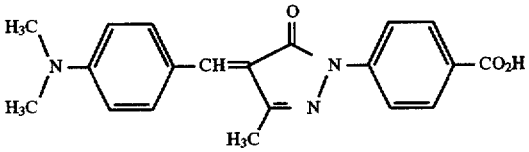
Dye D-2
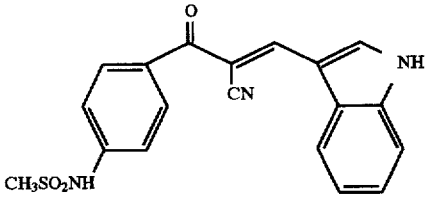
Dye D-3
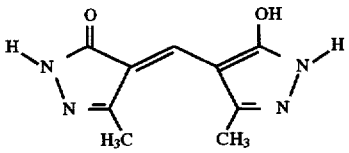
Dye D-4
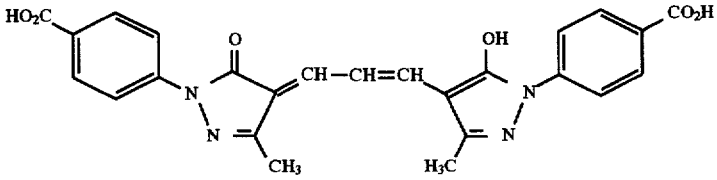
Dye D-5
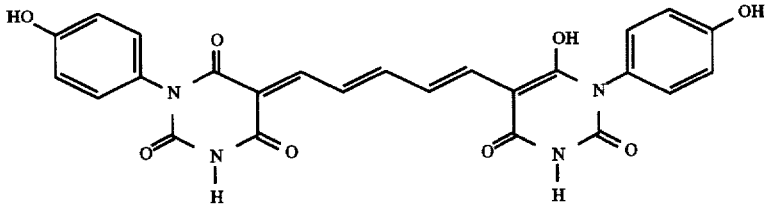
Dye D-6
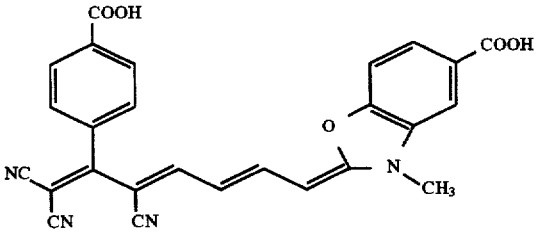
Dye D-7
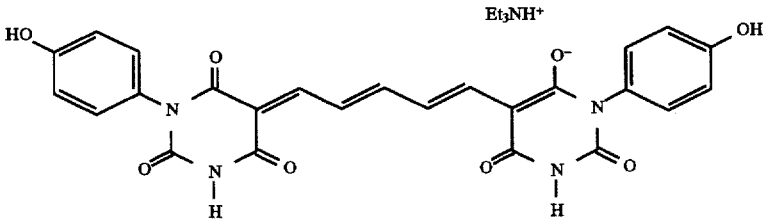
Dye D-8
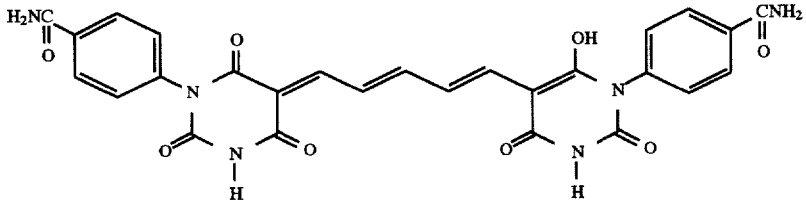

-continued
Dye D-9
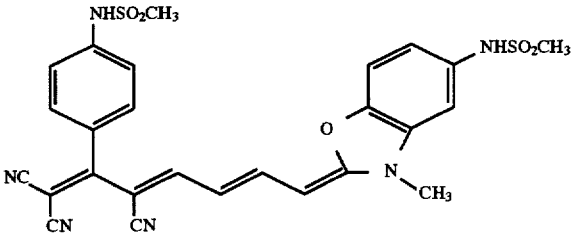
Dye D-10
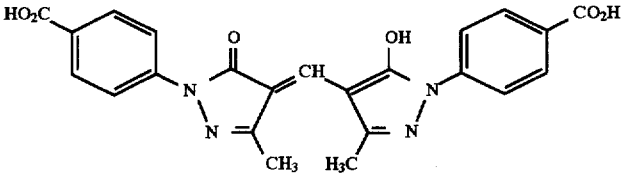
Dye D-11
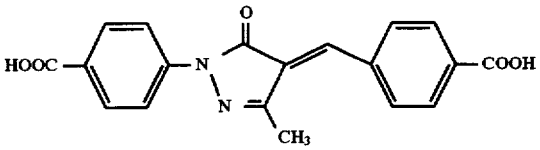
Dye D-12
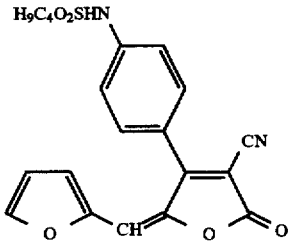
Dye D-13
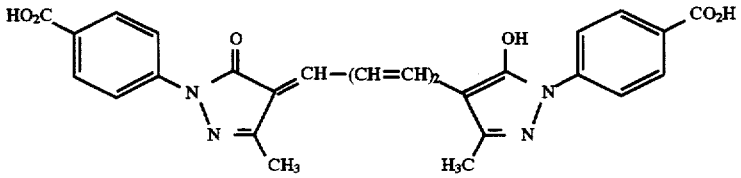
Dye D-14
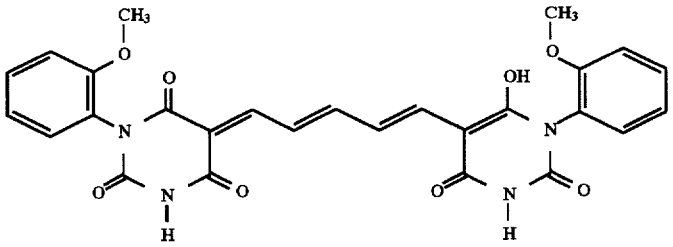
Dye D-15
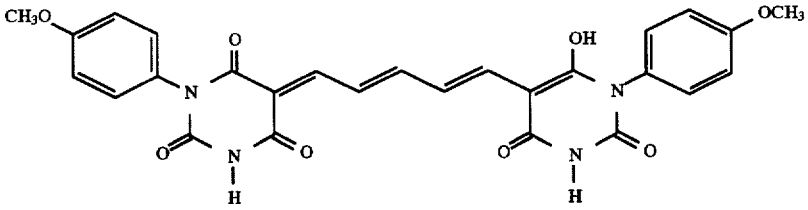

-continued

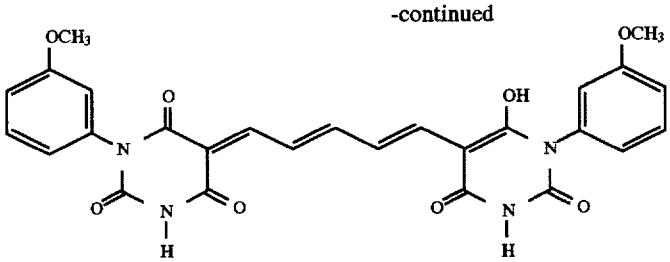

Dye D-16

In a particularly preferred embodiment of the invention, D represents a pentamethine oxonol-type barbituric acid dye residue, such as dyes D-5, D-7, D-8, D-14, D-15, and D-16 illustrated above, as these dyes have been found to exhibit absorption spectrums in the form of non-aqueous solid particle dispersions which are particularly advantageous for photographic element antihalation protection.

It is preferred that the filter dyes be substantially insoluble in a non-aqueous liquid for forming a solid particle non-aqueous dispersion, so that the dyes may be coated from organic coating solutions typically used for coating photographic element backing layers. By substantially insoluble is meant dyes having a solubility of less than 1% by weight in solution, preferably less than 0.1% by weight.

The solid particle non-aqueous dispersions can be prepared by mixing together a coarse slurry of the filter dye of interest in a nonaqueous liquid, with or without a dispersing aid and a binder. The slurry is then added to a mill where repeated collisions of milling media with the solid crystals in the slurry of the filter dye result in crystal fracture and resultant particle size reduction. The length of lime required to mill the particles to the desired particle size depends on the milling device used. In the dispersion form, the composition preferably contains from 5% to 80% by weight of the dye, the precise quantity depending upon the nature of the solid and liquid. The mill used to accomplish particle size reduction can be for example a colloid mill, swinging mill, ball mill, media mill, attritor mill, jet mill, vibratory mill, high pressure homogenizer, etc. These methods are described, e.g., in U.S. Pat. Nos. 4,006,025, 4,294,916, 4,294,917, 4,940,654, 4,950,586 and 4,927,744, and UK 1,570,362. The mill can be charged with the appropriate media such as, for example, sand, spheres of silica, stainless steel, silicon carbide, glass, zirconium, zirconium oxide, alumina, titanium, polymeric media such as cross-linked polystyrene beads, etc. The media sizes typically range from 0.25 to 3.0 mm in diameter, but smaller milling media, e.g. media having a mean particle size less than 100 microns, may also be used.

Generally for use in photographic imaging elements, a solid particle dispersion should have an average particle size of 0.01 to about 10 μm, preferably less than 3 μm, and more preferably, the solid particles are of a sub-micron average size. Even more preferably, the dispersed solid particles have a mean particle size of less than 0.5 micron, most preferably less than about 0.3 micron. In preferred embodiments the dispersed particles have a particle size of between 0.01 to about 1.0 micron, more preferably 0.01 to 0.5 and most preferably 0.05 to 0.3 micron. Generally, the desired particle sizes can be achieved by milling a solid particle dye slurry for 30 minutes to 31 days, preferably 60 minutes to 14 days, depending on the mill used.

The non-aqueous liquid of the filter dye dispersions may comprise any conventional organic solvent, such as a polar organic medium or a substantially non-polar aromatic hydrocarbon or halogenated hydrocarbon, in which the filter dye of the dispersion is substantially insoluble. By the term "non-aqueous liquid" is meant a liquid or liquid mixture containing less than 50 weight percent water. The non-aqueous liquid preferably contains less than 10 weight percent water, and most preferably contains less than 1 weight percent water. By the term "polar" in relation to an organic medium is meant an organic liquid or resin capable of forming moderate to strong bonds as described in the article entitled "A Three Dimensional Approach to Solubility" by Crowley et at. in *Journal of Paint Technology*, Vol. 38, p.269, 1966. Such organic media generally have a hydrogen bonding number of 5 or more as defined in the above mentioned article. While various dyes may have varying degrees of solubility in different non-aqueous liquids, the selection of an appropriate non-aqueous liquid in which to form the non-aqueous solid particle dispersions of the invention for a particular dye will be readily determinable by the artisan.

Examples of suitable polar organic liquids are amines, ethers, organic acids, esters, ketones, glycols, alcohols and amides. Numerous specific examples of such moderately and strongly hydrogen bonding liquids are given in the book entitled *Compatibility and Solubility* by I. Mellan, Table 2.14 on pp 39–40, 1968, and these liquids all fall within the scope of the term polar organic liquid as used in this specification. Preferred polar organic liquids are dialkyl ketones, alkyl esters of alkane carboxylic acids and alcohols, especially such liquids containing up to, and including, a total of 6 carbon atoms. Examples of such liquids are dialkyl and cycloalkyl ketones such as acetone, methyl-ethylketone, diethylketone, di-iso-propylketone, methyl-iso-butylketone, di-iso-butylketone, methyl-iso-amylketone, methyl-n-amylketone and cyclohexanone; alkyl esters such as methyl acetate, ethyl acetate, propyl acetate, isopropyl acetate, butyl acetate, methyl acetoacetate, ethyl formate, methyl propionate and ethyl butyrate, glycols and glycol esters and ethers, such as ethylene glycol, 2-ethoxyethanol, 3-methoxypropylpropanol, 3-ethoxypropylpropanol, 2-butoxyethyl acetate, 3-methoxypropyl acetate, 3-ethoxypropyl acetate and 2-ethoxyethyl acetate, alcohols such as methanol, ethanol, n-propanol, isopropanol, n-butanol and isobutanol and dialkyl and cyclic ethers such as diethylether and tetrahyrofuran.

Examples of substantially non-polar organic liquids which may be used, either alone or in a mixture with the aforementioned polar solvents, include aromatic hydrocarbons, such as toluene and xylene, halogenated aliphatic and aromatic hydrocarbons, such as trichloroethylene, percholorethylene, methylene chloride, and chlorobenzene.

Preferred organic liquids for use in forming the nonaqueous solid particle dispersions, as well as coating the dye and polyester-siloxane copolymer containing layers, include those commonly used in manufacture of photographic elements, such as ethyl acetate, propyl acetate, methanol, ethanol, butanol, n-propanol, methyl acetoacetate, and acetone. It is an advantage of the invention that many polyester-siloxane copolymers and co-binder combinations of the invention are coatable from such solvents.

In a preferred embodiment, a dispersant is present in the solid particle dispersions, preferably in the range of 1 to about 100%, more preferably about 5 to 75%, the percentage being by weight, based on the weight of the dye. The dispersant can be nonionic, such as: fatty alcohols, fatty acids, fatty esters, glycerol esters, diols, polyethoxylated diols, alkyl phenols, acetylinic glycols, alkanolamines and alkanolamides, polyethoxylated mercaptans, sorbitol and sorbitan derivatives, and nonionic block, graft, and comb copolymers; cationic, such as: polyester/polyamine copolymers, alkylamines, quaternary amines, imidazolines, dialkylamine oxides, polyester amines; anionic, such as salts of fatty acids, salts of multiple acids, sarcosine derivatives, salts of tall oil acids, sodium alkyl sulfonates, alpha-olefin sulfonates, alkylbenzene sulfonates, aromatic sulfonates, isothionates, sulfosuccinates, taurates, alcohol sulfates, alkyl phenol sulfates, sulfated triglycerides, alcohol phosphates; zwitterionic, such as: amino acids, imino acids, betaines, imidazolines, phospholipids; polymers such as: polyvinylpyrrolidones, polysaccharides, lignin derivatives, protein-based surfactants, polyacrylates, condensed naphthalene sulfonates, ethylene/acrylic acid copolymers, polesters, vinylbenzyl/methacrylate copolymers, polyethoxy/polypropoxy alcohol copolymers, and acrylic acid/isocyanate copolymers, as shown in the book *Dispersing Powders in Liquids* by R. D. Nelson, pp. 88–105, 1988, and the book entitled *Dispersions of Powders in Liquids* by G. D. Parfitt, Ed., pp. 177–191, 1986, incorporated herein by reference. Suitable materials useful in accordance with this invention are also described in U.S. Pat. Nos. 4,861,380 to Campell et al., 4,042,413 to Hauxwell et at., 4,156,616 to Dietz et al., and 4,019,923 to Mahe, incorporated herein by reference. Preferred materials include polyester amines sold by Zeneca, Inc. under the trade name designations Solsperse 24000 and Solsperse 20000 and by ICI Americas, Inc. under the trade name designations Hypermer LP4, Hypermer PS2 and Hypermer PS3; polyethylene oxide-polypropylene oxide block copolymers sold by BASF, Inc. under the trade name Pluronic, PluronicR, Tetronic and TetronicR; ethoxylated dialcohols sold by Air Products and Chemicals, Inc. under the trade names Surfynol 104, Surfynol 420, 440, 465, 485, 504, SE, SEF, DF-110, DF-210, DF-110L, DF-120, CT111, CT121, CT13 1, CT136, and CT324; and polyvinylpyrrolidones. It is understood that this list is representative only, and not meant to be exclusive.

The non-aqueous solid particle dispersions can be added to an organic solvent based coating composition containing a binder, for use in the preparation of a backing layer of a film support. The organic solvent may be selected, e.g., from the above referenced non-aqueous liquids. Where the dyes are incorporated in the outermost layer, the binder may consist of the polyester-siloxane copolymer in combinations with co-binders as discussed above. Where the dyes are incorporated in a separate layer between the outermost layer and the support, the binder may consist of any of such binders which are organic solvent-soluble materials which forms a substantially aqueous photographic processing solution insoluble film. Such film forming binders are preferably water insoluble vinyl co-polymers derived from any copolymerizable monomers, such as α,β-ethylenically unsaturated monomer (including two, three, or more repeating units) such as ethylene, propylene, 1-butene, isobutene, 2-methylpentene, 2-methylbutene, 1,1,4,4-tetramethylbutadiene, styrene, α-methylstyrene; monoethylenically unsaturated esters of aliphatic acids such as vinyl acetate, isopropenyl acetate, allyl acetate, etc.; esters of ethyleneically unsaturated mono- or dicarboxylic acids such as methyl methacrylate, ethyl acrylate, diethyl methylenemalonate, etc.; monoethylenically unsaturated compounds such as acrylonitrile, allyl cyanide, and dienes such as butadiene and isoprene. The particular monomer units and their proportions may be selected to achieve a desired glass transition temperature for the resulting polymer as is well known in the art. For effective abrasion resistance, the film forming polymer binders preferably have a glass transition temperature of about 20° C. or higher, more preferably about 40° C. or higher. The organic solvent soluble polymeric fill forming binders may also comprise a percentage of hydrophilic monomers (such as acrylic acids and acrylamides) to allow swelling of the backing layer to facilitate bleaching of the filter dyes, to the extent such hydrophilic monomers do not cause such binders to become readily soluble in alkaline processing solutions. The percentages of hydrophobic and relatively hydrophilic monomers may be selected by the artisan to obtain the desired degree of hardness and aqueous swellability, as long as the film remains photographic process surviving.

In accordance with a particular embodiment of the invention, a solid particle filter dye dispersion is included in the backing outermost layer, and the polyester-siloxane block copolymer functions as the dye layer binder in combination with other co-binders. It is an unexpected advantage of the invention that nonaqueous solid particle dye dispersions were found to be readily removed or decolorized upon photographic processing even from coatings formed from essentially hydrophobic polymeric binders such as the polyester-siloxane block copolymers in combination with co-binders.

In a further preferred embodiment of the invention, the photographic elements contain one or more conducting or antistatic layers such as, e.g., layers described in Research Disclosure, Vol. 176, December 1978, Item 17643 to prevent undesirable static discharges during manufacture, exposure and processing of the photographic element. Antistatic materials conventionally used in color photographic films have been found to be satisfactory for use herewith. Such materials include, e.g., anionic and cationic polymers, electronic conducting non-ionic polymers, electrically-conductive metal-containing particles such as metal halides or metal oxides in polymer binders. Any of the antistatic agents set forth is U.S. Pat. No. 5,147,768, e.g., the disclosure of which is incorporated herein by reference, may be employed.

Exemplary antistatic materials which may be used include, e.g., anionic, cationic, or electronic conducting non-ionic polymers, and metal halides or metal oxides in polymer binders. Conductive free particles of crystalline metal oxides dispersed with a polymeric binder have been used to prepare optically transparent, humidity insensitive, antistatic layers for various imaging applications. Many different metal oxides, such as AnO, $TiO_2$, $ZrO_2$, $Al_2O_3$, $SiO_2$, MgO, BaO, $MOO_3$, and $V_2O_5$, are disclosed as useful as antistatic agents in photographic elements or as conductive agents in electrostatographic elements in such patents as U.S. Pat. Nos. 4,275,103; 4,394,441; 4,416,963; 4,418,141; 4,431,764; 4,495,276; 4,571,361; 4,999,276; and 5,122,445, the disclosures of which are hereby incorporated by reference. Preferred metal oxides include antimony doped tin oxide, aluminum doped zinc oxide, and niobium doped titanium oxide, as these oxides have been found to provide acceptable performance characteristics in demanding environments. Particular preferred metal oxides for use in this invention are antimony-doped tin oxide, zinc antimonates, and vanadium pentoxide which provide good resistance to static discharge. Preferred polymeric antistats include polyanilines. In accordance with an advantage of the invention, the antistatic materials may be included in the permanent non-aqueous coated solid particle filter dye dispersion containing layer, or in a separate permanent layer, on the backside of the photographic element support to provide post-processing as well as pre-processing antistatic protection.

The antistatic materials may be included in the outermost layer, in an intermediate dye dispersion containing layer, or in a separate layer between the outermost layer or dye dispersion containing layer and the element support. To provide protection of the antistatic layer, a protective overcoat or barrier layer may be applied thereon. The protective layer can chemically isolate the antistatic layer, which is particularly desirable when using vanadium pentoxide antistatic materials, and also serve to provide additional scratch and abrasion resistance. The protective overcoat layers may be the same layer as the nonaqueous solid particle filter dye dispersion containing layer, or may be a separate layer, and may comprise, e.g., cellulose esters, cellulose nitrate, polyesters, acrylic and methacrylic copolymers and homopolymers, polycarbonates, polyvinyl formal polymethyl methacrylate, polysilicic acid, polyvinyl alcohol, and polyurethanes. The chemical resistance of the antistatic layer or an overcoat can be improved by incorporating a polymer cross-linking agent into the antistatic layer for those overcoats that have functionally cross-linkable groups. Cross-linking agents such as aziridines, carbodiimide, epoxys, and the like are suitable for this purpose.

Any suitable photographic film support may be employed in the practice of this invention, such as, cellulose derivatives including cellulose diacetate, cellulose triacetate, cellulose propionate, cellulose butyrate, cellulose acetopropionate and the like; polyamides; polycarbonates; polyesters, particularly polyethylene terephthalate, poly-1,4-cyclohexanedimethylene terephthalate, polyethylene 1,2-diphenoxyethane-4,4'-dicarboxylate, polybutylene terephthalate and polyethylene naphthalate; polystyrene, polypropylene, polyethylene, polymethylpentene, polysulfone, polyethersulfone, polyarylates, polyether imides and the like. Particularly preferred supports are polyethylene terephthalate, polyethylene naphthalate and the cellulose esters particularly cellulose triacetate. Depending on the nature of the support, suitable transparent tie or undercoat layers may be desired. Particularly with regard to polyester supports, primers are used in order to promote adhesion of coated layers. Any suitable primers in accordance with those described in the following U.S. patents, e.g., may be employed: U.S. Pat. Nos. 2,627,088; 3,501,301; 4,689,359; 4,363,872; and 4,098,952. The disclosures of each of these patents are incorporated herein by reference in their entirety.

The support of the imaging elements of this invention can also be coated with a magnetic recording layer as discussed in Research Disclosure, Item 34390, of November 1992, the disclosure of which is herein incorporated by reference. Magnetic materials as described in Research Disclosure, Item 34390 may also be coated in a single layer with the non-aqueous dispersions of the invention. In addition, various dyes may be formulated into the support or the magnetic layer to give neutral density if desired.

Generally, photographic elements in accordance with the invention are prepared by coating a support film on the side opposite the solvent-coated backing layers with one or more photosensitive layers comprising a silver halide emulsion in an aqueous solution of gelatin and optionally one or more aqueous coated gelatin subbing, inter, or overcoat layers. The aqueous coated layers may be coated before or after the solvent-coated backing layers are coated, but is preferably coated after such solvent coating is performed. The coating processes can be carried out on a continuously operating machine wherein a single layer or a plurality of layers are applied to the support. For multicolor elements, layers can be coated simultaneously on the composite support film as described in U.S. Pat. Nos. 2,761,791 and 3,508,947. Additional useful coating and drying procedures are described in Research Disclosure, Vol. 176, December 1978, Item 17643. Suitable photosensitive image forming layers are those which provide color or black and white images.

The photosensitive layers can be image-forming layers containing photographic silver halides such as silver chloride, silver bromide, silver bromoiodide, silver chlorobromide, and the like. Both negative working and reversal silver halide elements are contemplated. Suitable emulsions and film formats, as well as examples of other compounds and manufacturing procedures useful in forming photographic imaging elements in accordance with the invention, can be found in Research Disclosure, September 1994, Item 36544, published by Kenneth Mason Publication, Ltd., Dudley House, 12 North Street, Emsworth, Hampshire P010 7DQ, England, and the patents and other references cited therein, the disclosures of which are incorporated herein by reference. The preparation of single and multilayer photographic elements is also described in Research Disclosure 308119 dated December 1989, the disclosure of which is incorporated herein by reference.

It is specifically contemplated that the film formats, materials and processes described in an article titled "Typical and Preferred Color Paper, Color Negative, and Color Reversal Photographic Elements and Processing," published in *Research Disclosure,* February 1995, Volume 370, the disclosure of which is incorporated herein by reference, may also be advantageously used with the non-aqueous solid particle filter dye dispersion containing backing layers of the invention.

In accordance with the backing of the photographic elements of the invention, the properties of scratch and abrasion resistance and photographic process surviving lubricity are obtained. Additionally, in accordance with preferred embodiments, solid particle filter dyes can be essentially completely removed or decolorized from a photographic element backing upon photographic processing with an alkaline aqueous processing solution. The described elements can be, e.g., processed in conventional commercial photographic processes, such as the known C-41 color negative and RA-4 color print processes as described in *The British Journal of Photography Annual* of 1988, pages 191–199. Motion picture films may be processed with ECN or BCP processes as described in Kodak Publication No. H-24, Manual For Processing Eastman Color Films. Where applicable, the element may be processed in accordance with the Kodak Ektaprint 2 Process as described in Kodak Publication No. Z-122, using Kodak Ektaprint chemicals. To provide a positive (or reversal) image, the color development step can be preceded by development with a non-chromogenic developing agent to develop exposed silver halide, but not form dye, and followed by uniformly fogging the element to render unexposed silver halide developable. For elements that lack incorporated dye image formers, sequential reversal color development with developers containing dye image formers such as color couplers is illustrated by the Kodachrome K-14 process (see U.S. Pat. Nos. 2,252,718; 2,950,970; and 3,547,650). For elements that contain incorporated color couplers, the E-6 color reversal process is described in the *British Journal of Photography Annual* of 1977, pages 194–197.

The invention will be further illustrated by the following examples in which parts and percentages are given by weight unless otherwise specified.

EXAMPLE 1

Invention polyester-siloxane copolymer E-1 was prepared by addition of 37.56 g (185.0 mmol) of isophthaloyl chloride in dichloromethane to a solution of 61.581 g (183.15 mmol) of 2,2-bis(4-hydroxyphenyl) hexafluoropropane, 24.975 g (1.85 mmol) of aminopropyl-terminated polydimethylsiloxane of 14,000 molecular weight, and 37.4 mL (36.6 g, 463 mmole) of pyridine in 325 mL of dichloromethane at 10° C. The isophthaloyl chloride solution was added dropwise over 45 minutes. The reaction mixture was warmed to room temperature and stirred for 2 hours. To this solution, a 1% isophthaloyl chloride in dichloromethane was added dropwise until no further increase in viscosity is observed. The mixture was then stirred for 1 hour. The mixture was diluted with dichloromethane, washed with 10% HCl followed by three washes with distilled water. The solution was precipitated into methanol, and the polymer isolated by vacuum filtration, washed with methanol and dried under vacuum at 100° C. overnight, yielding 107 g (97%) of the desired product. The copolymer has an Mn of 23,650 and Mw of 67,600, and was found to be soluble in propyl acetate alone or with blends containing acetone or methanol.

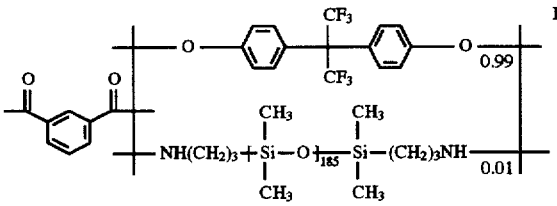

A comparison addition polymer CP-1 consisting of a 97/3 weight percent ratio of polymethyl methacrylate and polydimethyl siloxane blocks (siloxane blocks average molecular weight 13,700) respectively was also prepared by reaction of methyl methacrylate monomer and a macroazo polydimethylsiloxane initiator substantially as described in copending U.S. patent application Ser. No. 08/633,238, fried Apr. 16, 1995. CP-1 has an Mn of 273,000 and Mw of 624,000.

A cellulose triacetate support was coated on one side thereof with an organic solvent coated layer comprising solid particle dispersions of process-bleachable antihalation filter dyes D-1 and D-7 and a polymeric binder of ethyl acrylate, acrylic acid, and N,N-dimethyl acrylamide in a weight ratio of 2:1:1, similarly as described in Example 6 of copending U.S. patent application Ser. No. 08/698,413 incorporated by reference above. Coatings of each of polymers E-1 and CP-1 were prepared at several coverages, applied over the dye containing layers from a 0.5–2.0% solution in various solvent systems (PrAc represents propyl acetate, MeOH represents methanol), and dried.

The coatings were tested for coefficient of friction (ASTM Method #D1894, using an IMASS Instruments of Massachusetts flat bed tester and a carbide ball supported sled, at 21° C., 50% RH, and a test speed of 198 cm/min for 35 mm by 5 cm test strips) and orthochromatic optical density, both before and after processing in a commercially available motion picture photographic color development process which included processing in an alkaline aqueous solution at pH of above 8. The color process was the Eastman ECN-2 development process, commercially available from Eastman Kodak Co., U.S.A. The ECN-2 process is described in, e.g., "Manual for Processing Eastman Color Film—H-24", available from Eastman Kodak Company, Rochester, N.Y.

A preferred range for coefficient of friction is 0.1–0.3, more preferably 0.1–0.2. Optical density should be greater than about 0.4, more preferably greater than 0.8, and most preferably greater than 1.0 before processing and less than 0.2, more preferably less than 0.1, after processing. The physical properties of the coatings are given in Table 1.

TABLE 1

POLYSILOXANE BLOCK COPOLYMERS EMPLOYED AS OVERCOATS

| | | Coverage | Coefficient of Friction | | Optical Density | |
|---|---|---|---|---|---|---|
| Polymer | Ctg. Solvent | (mg/m$^2$) | raw | processed | raw | processed |
| none (check) | | — | 0.49 | 0.50 | 0.45 | 0.04 |
| E-1 | 90/10 PrAc/MeOH | 215 | 0.10 | 0.49 | 0.72 | 0.05 |
| E-1 | 90/10 PrAc/MeOH | 108 | 0.13 | 0.45 | 0.71 | 0.05 |
| E-1 | 90/10 PrAc/MeOH | 54 | 0.15 | 0.48 | 0.73 | 0.05 |
| E-1 | 90/10 PrAc/MeOH | 11 | 0.35 | 0.49 | 0.74 | 0.05 |
| CP-1 | 50/50 Acetone/MeOH | 11 | 0.56 | 0.51 | 0.80 | 0.05 |
| CP-1 | 50/50 Acetone/MeOH | 54 | 0.49 | 0.52 | 0.80 | 0.06 |
| CP-1 | 50/50 Acetone/MeOH | 215 | 0.41 | 0.52 | 0.70 | 0.06 |
| CP-1 | 50/50 Acetone/MeOH | 108 | 0.45 | 0.53 | 0.70 | 0.05 |

The results of this evaluation, shown in Table 1, indicate that the E-1 polymer overcoat provided an acceptable level of friction (0.10–0.20) at levels above about 50 mg/m$^2$ prior to processing, however, post-processing friction levels indicate the polyester-siloxane coating or functionality is removed or destroyed during processing. Overcoats prepared with the CP-1 polymer all exhibited an unacceptably high level of friction, both raw and processed.

EXAMPLE 2

Polyester-siloxane copolymer E-1 was coated along with various co-binders in an outermost layer onto a support similarly to Example 1. Co-binder CB-1 is a medium molecular weight poly(methyl methacrylate) homopolymer (ELVACITE 2009), CB-2 is a low molecular weight poly (ethyl methacrylate) (ELVACITE 2043), and CB-3 is a low molecular weight poly(methyl/n-butyl methacrylate) copolymer (ELVACITE 2614), each commercially available from ICI Acrylics, Inc. The binder blends in this example, however, were used as binders to carry the anti-halation dyes used in Example 1, thus allowing application of a single lubricating/antihalation layer. All coatings were dried as above. The results are summarized in Table 2.

TABLE 2

POLYESTER-SILOXANE BLOCK COPOLYMERS COATED WITH CO-BINDER IN OUTERMOST LAYER WITH ANTIHALATION DYES

| | | Dye Conc. | Coverage | Coefficient of Friction | | Optical Density | |
|---|---|---|---|---|---|---|---|
| Polymer | Ctg. Solvent | (wt. %) | (mg/m$^2$) | raw | processed | raw | processed |
| 90/10 CB-1/E-1 | Propyl Acetate | 50 | 431 | 0.26 | 0.25 | 0.56 | 0.02 |
| 90/10 CB-1/E-1 | Propyl Acetate | 50 | 646 | 0.22 | 0.22 | 0.84 | 0.03 |
| 80/20 CB-1/E-1 | Propyl Acetate | 50 | 646 | 0.19 | 0.18 | 0.73 | 0.03 |
| 80/20 CB-1/E-1 | Propyl Acetate | 50 | 431 | 0.20 | 0.19 | 0.64 | 0.02 |
| 90/10 CB-2/E-1 | Propyl Acetate | 50 | 431 | 0.23 | 0.22 | 0.61 | 0.02 |
| 90/10 CB-2/E-1 | Propyl Acetate | 50 | 646 | 0.21 | 0.20 | 0.82 | 0.03 |
| 80/20 CB-2/E-1 | Propyl Acetate | 50 | 646 | 0.18 | 0.15 | 0.77 | 0.03 |
| 80/20 CB-2/E-1 | Propyl Acetate | 50 | 431 | 0.18 | 0.16 | 0.64 | 0.02 |
| 90/10 CB-3/E-1 | Propyl Acetate | 50 | 431 | 0.25 | 0.25 | 0.59 | 0.02 |
| 90/10 CB-3/E-1 | Propyl Acetate | 50 | 646 | 0.22 | 0.22 | 0.88 | 0.03 |
| 80/20 CB-3/E-1 | Propyl Acetate | 50 | 646 | 0.19 | 0.18 | 0.75 | 0.03 |
| 80/20 CB-3/E-1 | Propyl Acetate | 50 | 431 | 0.19 | 0.19 | 0.61 | 0.02 |

Table 2 indicates that the polymer blends in accordance with the invention comprising a polyester-siloxane block copolymer and a co-binder which does not contain polysiloxane block units may be coated in an outermost backing layer and that such outermost layer provides process-surviving lubricity. Preferable levels of friction were obtained if the polyester-siloxane block copolymer portion of the binder mixture comprised more than 10% of the total binder. Friction remained substantially unaffected by processing. Binder mixtures in accordance with the invention may also serve as useful binders, or vehicles, for the anti-halation dyes thus providing similar properties in a single layer. Substantial pre-process optical densities may be obtained, while post-process density readings indicate substantially complete removal of the antihalation dyes. Comparison coatings based on using comparison polymer CP-1 as a binder in a single lubricating/antihalation layer produced the same undesirably high level of friction both before and after processing as was seen with the overcoats of this material.

EXAMPLE 3

Further experiments similar to those of Example 2 were conducted wherein the dye, binders, and lubricant percentages, and dry coverages were varied. Such experiments demonstrated that the friction and density values could each be further optimized within desired ranges in accordance with increasing or decreasing the percentages and absolute coverages of such compounds.

EXAMPLE 4

Color photographic negative working elements are prepared comprising a cellulose triacetate support coated on one side thereof with an antistat layer comprising zinc antimonate and cellulose diacetate, overcoated with an organic solvent coated layer comprising filter dyes and a polyester-siloxane copolymer and co-binder which does not contain polysiloxane block units in accordance with the invention substantially as described above. The opposite side of the support is coated with a gelatine subbing layer, aqueous coated slow, mid and fast red sensitive, cyan dye forming emulsion layers, slow, mid and fast green sensitive, magenta dye forming emulsion layers, slow, mid and fast blue sensitive, yellow dye forming emulsion layers, various interlayers and an overcoat layer substantially as described in Example 2 of U.S. Pat. No. 5,283,164, the disclosure of which is incorporated by reference. The film is exposed and subsequently processed in a ECN-2 development process. The non-aqueous coated dispersions of solid particle filter dyes D-1 and D-7 are substantially removed after processing, while the backing retains lubricity.

The invention has been described in detail with particular reference to preferred embodiments thereof, but it will be understood that variations and modifications can be effected within the spirit and scope of the invention.

We claim:

1. A photographic element comprising (a) a support, (b) a radiation-sensitive silver halide emulsion layer on one side of the support, and (c) a protective backing on the opposite side of the support comprised of one or more layers, the outermost of which comprises a film-forming hydrophobic lubricious polyester-siloxane block copolymer and a hydrophobic co-binder which does not contain polysiloxane block units.

2. A photographic element according to claim 1, wherein the polysiloxane block components of the polymer comprise more than 3 weight % of the copolymer and the average molecular weight of the polysiloxane block components is greater than 1500.

3. A photographic dement according to claim 2, wherein the polyester-siloxane block copolymer contains recurring units having the structural formula:

$$+A+B+\!\!+C+$$

wherein A represents units derived from carbonic acid or an aromatic or aliphatic dicarboxylic acid;

B represents units derived from an aromatic or aliphatic diol; and

C represents a polysiloxane block unit derived from a polysiloxane compound having the structural formula:

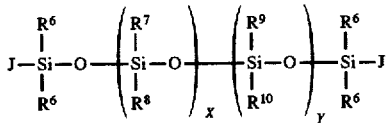

wherein:

each J independently represents a reactive end group which is removed to form a direct bond with A and B units forming silyl ester linkages, or an aliphatic, cycloaliphatic, or aromatic organic group having a reactive end group which forms amide, urethane or ester linkages with the A and B units;

$R^6$, $R^7$, $R^8$, $R^9$, and $R^{10}$ each independently represents aryl, alkyl or fluoroalkyl; and the values of X and Y are each from 0 to about 400, such that the value of X+Y is from 20 to about 400.

4. A photographic element according to claim 1, wherein the outermost layer is coated over a filter dye containing antihalation layer.

5. A photographic element according to claim 4, wherein the antihalation layer comprises a solid particle dye dispersion of a filter dye which is readily soluble or decolorizable in alkali aqueous photographic processing solutions at pH of 8 or above dispersed in an alkaline aqueous insoluble, organic solvent soluble film forming binder.

6. A photographic element according to claim 5, further comprising antistatic agents in at least one photographic process surviving layer on the same side of the support as the antihalation layer and outermost layer, which process surviving layer may be either the same layer as the antihalation layer or the outermost layer, or may be an additional layer, such that the film support also has antistatic protection retained after photographic processing.

7. A photographic element according to claim 5, wherein the solid particle filter dye dispersion comprises a dye of the formula (I):

$$D—(X)_n \qquad (I)$$

where D represents a residue of a compound having a chromophoric group which is substantially insoluble in the non-aqueous liquid, X represents a group having an ionizable proton bonded to D either directly or through a bivalent bonding group, and n is 1–7.

8. A photographic element according to claim 5, wherein the polyester-siloxane copolymer comprises from about 3 to 80 wt % of the total polymeric binder weight in the outermost layer, and the total binder coverage in the outermost layer is from about 100 to 500 mg/m$^2$.

9. A photographic element according to claim 8, wherein the polyester-siloxane copolymer comprises from about 15 to 50 wt % of the total polymeric binder weight in the outermost layer.

10. A photographic element according to claim 8, wherein the co-binder comprises an acrylic ester homopolymer or copolymer.

11. A photographic element according to claim 1, wherein the polyester-siloxane copolymer comprises from about 3 to 80 wt % of the total polymeric binder weight in the outermost layer, and the total binder coverage in the outermost layer is from about 100 to 500 g/m$^2$.

12. A photographic element according to claim 11, wherein the polyester-siloxane copolymer comprises from about 15 to 50 wt % of the total polymeric binder weight in the outermost layer.

13. A photographic element according to claim 1, wherein the co-binder comprises an acrylic ester homopolymer or copolymer.

14. A photographic element according to claim 1, wherein the outermost layer further comprises a solid particle dye dispersion of a filter dye which is readily soluble or decolorizable in alkali aqueous photographic processing solutions at pH of 8 or above dispersed in an alkaline aqueous insoluble, organic solvent soluble film forming binder.

15. A photographic element according to claim 14, further comprising antistatic agents in at least one photographic process surviving layer on the same side of the support as the outermost layer, which process surviving layer may be either the same layer as the outermost layer or may be an additional layer, such that the film support also has antistatic protection retained after photographic processing.

16. A photographic element according to claim 14, wherein the solid particle filter dye dispersion comprises a dye of the formula (I):

$$D—(X)_n \qquad (I)$$

where D represents a residue of a compound having a chromophoric group which is substantially insoluble in the non-aqueous liquid, X represents a group having an ionizable proton bonded to D either directly or through a bivalent bonding group, and n is 1–7.

17. A photographic element according to claim 14, wherein the polyester-siloxane copolymer comprises from about 3 to 80 wt % of the total polymeric binder weight in the outermost layer, and the total binder coverage in the outermost layer is from about 100 to 500 g/m$^2$.

18. A photographic element according to claim 17, wherein the polyester-siloxane copolymer comprises from about 20 to 50 wt % of the total polymeric binder weight in the outermost layer.

19. A photographic element according to claim 17, wherein the co-binder comprises an acrylic ester homopolymer or copolymer.

20. A photographic element according to claim 14, wherein the co-binder comprises an acrylic ester homopolymer or copolymer.

* * * * *